United States Patent [19]

Sakurada et al.

[11] Patent Number: 4,506,531

[45] Date of Patent: Mar. 26, 1985

[54] CONTROL METHOD AND APPARATUS FOR SCREWING DOWN REELING ROLLS

[76] Inventors: Kazuyuki Sakurada, 159-170 Taketoyo-cho, Kitanakane, Chita-gun, Aichi-ken; Yutaka Funyu, 4-10-16 Hanazone-cho, Handa-shi, Aichi-ken; Fusao Togashi, 46-1 Taketoyo-cho, Aza Minami Nagamune, Chita-gun, Aichi-ken; Toyoji Kanno, 5-4-1 Hanazono-cho, Handa-shi, Aichi-ken; Toshikazu Masuda, 1-24 Agui-cho, Ooaza Miyazu Aza Kobasama, Chita-gun, Aichi all of Japan

[21] Appl. No.: 355,728

[22] PCT Filed: Jun. 30, 1981

[86] PCT No.: PCT/JP81/00150

§ 371 Date: Mar. 15, 1983

§ 102(e) Date: Mar. 15, 1983

[87] PCT Pub. No.: WO82/00108

PCT Pub. Date: Jan. 21, 1982

[30] Foreign Application Priority Data

Jul. 4, 1980 [JP] Japan ..... 55-91294

[51] Int. Cl.[3] ..... B21B 37/12

[52] U.S. Cl. ..... 72/8; 72/13; 72/248; 72/366

[58] Field of Search ..... 72/8, 11, 12, 13, 69, 72/95, 96, 248, 366; 364/472

[56] References Cited

U.S. PATENT DOCUMENTS 4,087,859 2/1978 Anbe ..... 364/472
4,365,496 12/1982 Shiozaki ..... 72/17

FOREIGN PATENT DOCUMENTS 134305 2/1979 German Democratic Rep. ..... 72/8
395138 12/1973 U.S.S.R. ..... 72/11

OTHER PUBLICATIONS

Napadajlo, I. T., East German Patent 134,305, English Translation.

Yu, B., Lots, Russian Inventor's Certificate 395,138, English Translation.

*Primary Examiner*—Francis S. Husar
*Assistant Examiner*—Charles Rosenberg
*Attorney, Agent, or Firm*—Oblon, Fisher, Spivak, McClelland & Maier

[57] ABSTRACT

A control method for controlling the screwing down pressure provided in a reeling mill where the reels are controlled by a combination of signals continuously monitored by a computer. The signals include the temperature of the pipe entering the reeling mill, the voltage and current supplied to the reeling motor and the speed of the reeling motor. A calculation is then performed which gives the actual reduction of wall thickness based upon a predetermined relationship of the temperature of the pipe entering the reeling mill and the torque of the rolling motor. The torque is calculated based upon the speed, current and voltage of the rolling motor. The pressure supplied to the rolling reels is then altered based on this signal.

2 Claims, 3 Drawing Figures

CONTROL METHOD AND APPARATUS FOR SCREWING DOWN REELING ROLLS

FIELD OF THE INVENTION

This invention relates to a method for automatic control of the screwing-down of reeling rolls in a reeling mill. More particularly, the invention relates to a method for automatically controlling the screwing-down of rolls in the process of reeling in the production of seamless steel pipes by the Mannesman plug mill method.

BACKGROUND OF THE INVENTION

The reeling mill (reeler) is layed between the plug mill and sizing mill in the process for manufacture of seamless steel pipes. In this mill, the pipe is "reeled" by reducing its wall thickness for various purposes among which are the correction of the thickness deviation that has developed in the previous rolling mills (i.e. piercer, elongator and plug mill), elimination of the flaws developed by abrasion with the plug in the plug mill rolling, and ensuring a suitable amount of pipe expansion for the sizing mill in the subsequent step. It is the most important feature of the reeling mill that the greater part of the amount of reduction in wall thickness changes into the expansion of the outside diameter of the pipe, so if a variation occurs in the amount of reduction of the wall thickness during reeling, the outside diameter of the reeled pipe also changes in its longitudinal direction and the following disadvantages result: if the amount of reduction in wall thickness during reeling is small, the degree of increase in the outside diameter is small and the desired outside diameter of the pipe cannot be achieved, and vice versa. If the outside diameter of the reeled pipe is smaller than a predetermined value, not all parts of the pipe is rolled in the subsequent sizing mill, which has a very adverse effect on the outside diameter of the final product. If the outside diameter of the reeled pipe is larger than the predetermined value, a flaw such as one due to the roll edges develops during rolling in the sizing mill, which is also detrimental to the quality of the final product. So, the operation in the reeling mill has great effect on the accuracy of the dimensions of the final product, hence its yield, and it is mandatory in the reeling mill to roll the pipe to have the desired outside diameter.

Several methods are known for controlling the operation of reeling mills. One of them is described in Japanese Patent Application (OPI) No. 37568/78 (the symbol OPI as used herein means an unexamined published Japanese Patent Application), and to provide a pipe of constant outside diameter on the leaving side of the mill, the electric power for rolling is kept constant for each lot and for the entire length of each pipe to be rolled. Another method is described in Japanese Patent Application (OPI) No. 86663/78, and to provide a pipe of constant wall thickness on the leaving side, the pattern of electrical power outputs is determined for each pipe on the basis of information of the cross section and temperature of the pipe on the entry side so that the cross section of the pipe on the leaving side is kept constant for each lot and for the entire length of each pipe, and the electric power for rolling is changed after this pattern.

The method of Japanese Patent Application (OPI) No. 37568/78 disregards the change in the temperature of each pipe to be rolled as well as the change in the temperature in the longitudinal direction of the pipe. So, if the reeling operation is performed with the electric power held constant, the reduction in the wall thickness at the low temperature portion of pipe where occurs the larger resistance to deformation is so small that the pipe on the leaving side cannot be expanded to the predetermined value of outside diameter. What is more, the outside diameter of the pipe on the entry side of the mill is also varied in longitudinal direction by the rolling force and by the set of roll gap in the plug mill rolling, so this adds to the variation in the outside diameter of the pipe that is leaving the reeling mill under the control of constant electric power.

The method of Japanese Patent Application (OPI) No. 86663/78 achieves its object by changing the desired electric power according to a predetermined pattern by taking into account the change in the temperature of the pipe in its longitudinal direction, but as in the first method, it disregards the change in the outside diameter of the pipe on the entry side in defining the target value for the electric power that provides a pipe of constant cross-sectional area on the leaving side of the mill. As a result, there occurs a variation in the outside diameter of the reeled pipe both in the longitudinal direction and with respect to the average outside diameter of the pipes for each lot. The second method has another defect: the pipe to be fed into the plug mill generally has such a temperature distribution in the longitudinal direction that the temperature increases from the leading end to the trailing end, and so the wall thickness of the pipe leaving the plug mill often increases from the leading end to the trailing end. Therefore, the pipe entering the reeling mill generally has a cross section that decreases from the loading end to the trailing end.

To reel the pipe having a cross-sectional area of the pattern described above and provide a product whose cross section is uniform in the longitudinal direction, the amount of reduction in wall thickness must be decreased from the leading to trailing edge, but then, the resulting pipe on the leaving side has an outside diameter that decreases from the leading to trailing end and which is not desired in the final product. Still another defect that is common to the two methods is that in spite of the supply of a constant electric power for rolling, a change in the speed of the rolling motor during reeling causes change in the rolling torque, and as a result, the desired outside diameter is not attained.

Therefore, one object of this invention is to provide a control method for screwing down the reeling rolls that is free from the above described defects of the conventional techniques and which keeps providing a pipe of constant outside diameter on the leaving side of the reeling mill by first determining the desired amount of reduction in wall thickness in the longitudinal direction of the pipe being reeled, calculating the actual amount of reduction in wall thickness from the torque of the rolling motor and the temperature of the pipe on the entry side and controlling said actual amount of reduction in wall thickness to be equal to the desired amount of reduction in wall thickness.

Another object of this invention is to provide a control method for screwing down the reeling rolls that achieves quantitative adjustment of the roll gap so that the pipe leaving the reeling mill has a uniform outside diameter in the longitudinal direction.

Still another object of this invention is to provide an apparatus that is used with advantage in performing the above described control methods.

DESCRIPTION OF THE INVENTION

According to this invention, a control method for screwing down reeling rolls is provided that keeps providing a pipe of constant outside diameter on the leaving side of the reeling mill. To achieve this purpose, the desired amount of reduction in the wall thickness of the pipe being reeled is determined for the longitudinal direction of the pipe from the outside diamter and average wall thickness of the pipe on the entry side of the reeling mill and the desired outside diameter of the pipe on the leaving side, the actual amount of reduction in the wall thickness of the pipe being reeled is calculated for the longitudinal direction of the pipe from the temperature of the pipe on the entry side of the reeling mill and the rolling torque of a rolling motor, and the degree of screwing down the reeling rolls is controlled so that the actual amount of reduction in wall thickness is equal to said desired amount of reduction in wall thickness.

This invention also provides a control apparatus for screwing down reeling rolls which includes a wall thickness and OD arithmetic means for calculating the average wall thickness and the outside diameter of a pipe being fed into the reeling rolls, an AGC means which receives information on said average wall thickness and outside diameter of the pipe on the entry side of the reeling mill, the temperature of the pipe on the entry side of the reeling mill, the voltage and current applied to the armature of a rolling motor, the speed of rotation of the motor, and the desired outside diameter of the pipe on the leaving side of the mill, and calculates the desired amount of reduction in wall thickness and the actual amount of reduction in the wall thickness of the pipe being rolled to thereby deliver a signal indicative of the difference between the desired amount of reduction in wall thickness and the actual amount of reduction in wall thickness, and a screw down motor control means that delivers a screw down signal to a screw down motor in response to the difference signal. The AGC means as used herein means an "automatic roll gap control means" which delivers a signal indicative of the difference between the desired amount of reduction in wall thickness and the actual amount of reduction in wall thickness to the screw down motor control means for driving the motor.

DESCRIPTION OF THE PREFERRED EMBODIMENTS

Figure 1:
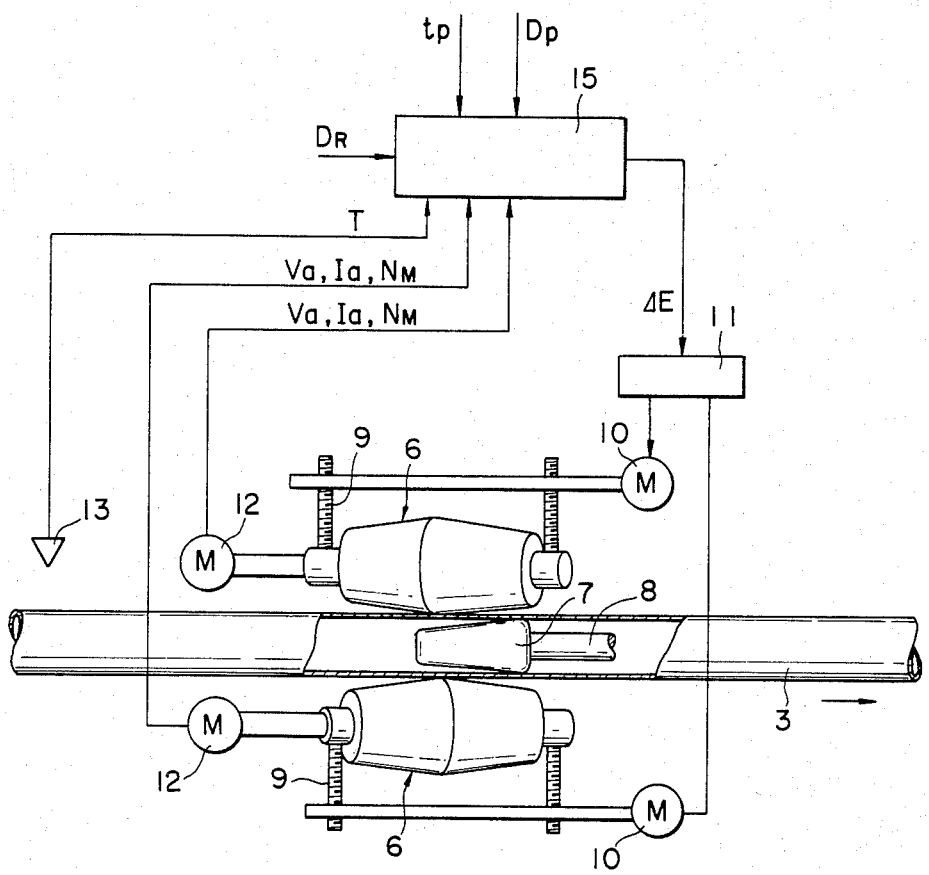
FIG. 1 is a block diagram showing the control system of this invention as used in a reeling mill.
Figure 2:
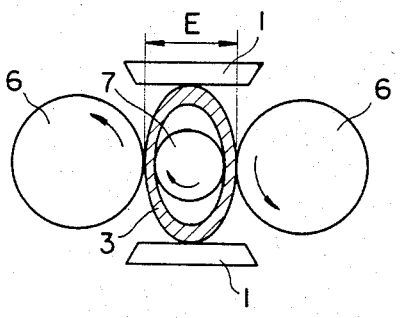
FIG. 2 shows schematically a cross section of a pipe being rolled in the reeling mill.

One preferred embodiment of this invention is now described specifically by reference to the accompanying drawings. FIG. 1 is a block diagram showing the control system of this invention as used in a reeling mill. FIG. 2 is a schematic representation of a cross section of a pipe being rolled in the reeling mill. As shown, a pipe 3 is rolled by a pair of barrel-shaped reeling rolls 6,6 (the longitudinal axes of which cross each other) and a reeling plug 7. As the rolls and plug rotate to the directions indicated by the arrows, the reduction in the wall thickness is performed. As a result, the thickness deviation and flaws such as abrasions caused by the plug in the preceding rolling are eliminated. In the Figures, 1 is a guide shoe that regulates the vertical position of the pipe 3,8 is a plug bar of the plug 7,9 is a screw attached to the shafts of the rolls 6,6 for controlling the roll gap, 10 is a screw down motor for operating the screw 9, and 12 is a rolling motor that rotates the rolls 6,6. In the reeling step, the greater part of the amount of reduction in wall thickness is converted into the expansion of the outside diameter of the pipe, so it is necessary to control the amount of reduction in wall thickness for the purpose of controlling the outside diameter of the pipe that leaves the reeling mill.

To know the relation between the amount of reduction in wall thickness and the expansion of the outside diameter of the pipe, we have analyzed many data that were obtained by our reeling operations, and have found that the desired amount of reduction in wall thickness ($\Delta t_o$) can be determined by the following formula (1):

$$\Delta t_o = t_p - \frac{D_R}{2} + \sqrt{\left(\frac{D_R}{2}\right)^2 - \alpha(D_p - t_p)t_p} \quad (1)$$

$\Delta t_o$: the desired amount of reduction in wall thickness;

$D_R$: the desired outside diameter of the reeled pipe (constant in longitudinal direction);

$D_P$: the actual outside diameter of pipe leaving the plug mill (OD pattern in longitudinal direction); and $t_p$: the average wall thickness of the pipe leaving the plug mill.

In the formula, the value of $\alpha$ is determined for the dimensions of a specific pipe and the kind of the steel. By using this formula one can determine optimum amount of screwing down the reeling rolls for attaining the desired outside diameter of the leaving pipe ($D_R$) even if the outside diameter of the incoming pipe ($D_P$) varies in the longitudinal direction of the pipe.

The method of determining the outside diameter of the pipe leaving the plug mill ($D_p$) and its average wall thickness ($t_p$) is described below.

Figure 3:
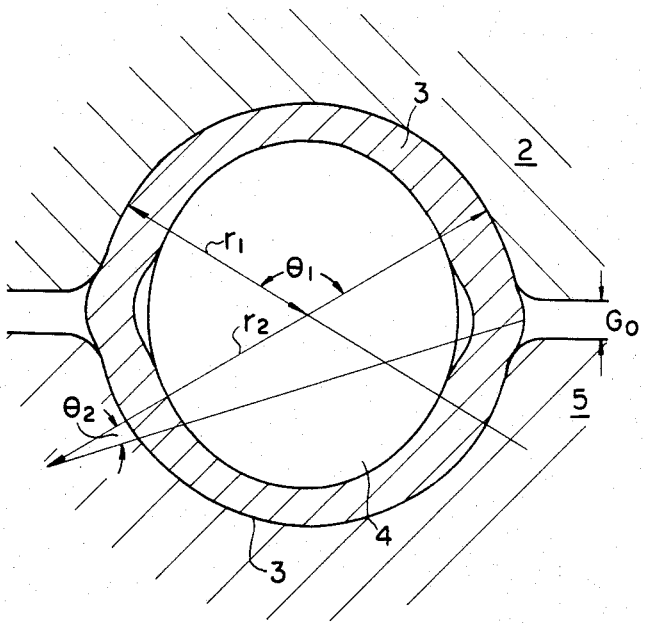
FIG. 3 shows schematically a cross section of a pipe being rolled in a plug mill prior to the reeling mill.

The outside diameter at various points in the longitudinal direction of the pipe leaving the plug mill is calculated by the following formula (2) from the shape of the caliber formed by upper and lower rolls in the plug mill (as indicated by 2 and 5 in FIG. 3), the roll gap G, and the rolling load P for the operation of the plug mill. The formula (3) can be easily obtained from FIG. 3 wherein a rolling plug is indicated by 4.

$$D_p = \frac{2r_1\theta_1 + 4r_2\theta_2 + 2\left(G - G_o + \frac{P}{M}\right)}{\pi} \quad (2)$$

wherein $G_o$ is a reference roll gap, M is the mill rigidity of the plug mill, $r_1$ is the radius of the bottom of the caliber, $r_2$ is the radius of the flange of the caliber, $\theta_1$ is the angle of a sector having a radius $r_1$, and $\theta_2$ is the angle of a sector having a radius $r_2$.

The rolling load P and roll gap G vary not only for each pipe but also in the longitudinal direction of the same pipe being rolled, so they are the factors that cause a change in the outside diameter in longitudinal direction of the pipe leaving the plug mill. The leading and trailing low-temperature ends of the pipe being fed into the plug mill are placed under a rolling load significantly higher than the one applied to the middle of the pipe, so the difference between the outside diameter of the leading and trailing ends and that of the middle portion is not negligible.

The outside diameter of the pipe leaving the plug mill can be obtained directly without using the formula (2). In the direct method, the outside diameter of the pipe leaving the plug mill or coming into the reeling mill is measured continuously in the longitudinal direction by an OD measuring instrument. The average outside diameter of the pipe leaving the plug mill ($\overline{D}_p$) that is mentioned hereunder is determined by averaging the respective values of the outside diameter measured at various points of the pipe in the longitudinal direction. The data of $\overline{D}_p$ is fed into the AGC means 15 (FIG. 1) as information on the outside diameter of the pipe on the entry side of the reeling mill.

The average wall thickness ($t_p$) of the pipe leaving the plug mill is determined by the following procedure. The weight of a billet is measured before it is charged into the heating furnace, the weight of the pipe in the plug mill (W) is determined by subtracting the scale loss in the heating furnace, etc., and the length of the pipe ($l_p$) that has been rolled for the final pass in the plug mill is measured directly. The value of $t_p$ is calculated by the following formula (3) from the measurements of W, $l_p$ and $\overline{D}_p$:

$$t_p = \frac{\overline{D}_p}{2} - \sqrt{\left(\frac{\overline{D}_p}{2}\right)^2 - \frac{W}{\pi \cdot \rho_p \cdot l_p}} \tag{3}$$

wherein $\rho_p$ is the density of the steel and depends on the temperature of the steel. The data on the average wall thickness ($t_p$) is fed into the AGC means 15 as information on the wall thickness of the pipe on the entry side of the reeling mill.

On the basis of the formulas (1), (2) and (3) described above, one can determine the optimum (desired) amount of reduction in wall thickness ($\Delta t_o$) for both a specific pipe and its longitudinal direction that is necessary to attain the desired outside diameter $D_R$ of the pipe on the leaving side of the reeling mill. Alternatively, the wall thickness ($t'_p$) may be directly determined by a pipe thickness measuring instrument as in the case of direct measurement of the outside diameter of the pipe. For this purpose, a known hot wall thickness gauge is installed on the leaving side of the plug mill, and the respective values of the wall thickness of the pipe leaving the plug mill that are obtained by continuous measurements are averaged to calculate the $t_p$.

The actual amount of reduction in wall thickness ($\Delta t_A$) is determined from the electric power of the rolling motor in the reeling mill and the temperature of the pipe on the entry side of the reeling mill by taking into consideration the resistance to deformation. We have discovered the following formula (4) that represents the relation between the rolling torque of the rolling motor and the amount of reduction in wall thickness. The formula assumes the use of a d.c. motor.

$$\left.\begin{aligned} \Delta t_A &= \frac{T_{rq}}{K_f \cdot (\beta \cdot D_R + \gamma)} \\ T_{rq} &= \frac{V_a \cdot I_a}{N_M} \end{aligned}\right\} \tag{4}$$

$V_a$: the voltage on the armature of the rolling motor,
$I_a$: the current on the armature of the rolling motor,
$N_M$: the motor speed,
$K_f$: resistance to deformation, $D_R$: the desired OD of the pipe leaving the reeling mill, $\beta,\gamma$: constants. The resistance to deformation ($K_f$) is determined from the temperature of the pipe being rolled (T), carbon content of steel, etc. Many formulas have been proposed for calculation of $K_f$ and a suitable one may be selected depending upon the need. The temperature of the entry pipe being rolled is measured on the entry side of the reeling mill (T) with a thermometer 13. The exit temperature is measured on the exit side of the reeling mill by thermometer 14. Needless to say, $K_f$ varies in the course of rolling according to the temperature pattern in the longitudinal direction of the pipe. The data on the factors described above are fed into the AGC means 15 of FIG. 1 which calculates the actual amount of reduction in wall thickness $\Delta t_A$ by the formula (4) on the basis of these data and those on $I_a$, $V_a$, $N_M$ and T which are also fed to the AGC. The so determined actual amount of reduction in wall thickness $\Delta t_A$ is substracted from the desired amount of reduction in wall thickness $\Delta t_o$, and the position to which the reeling rolls are screwed down is adjusted according to the difference. The roll gap E is adjusted to E-2 ($\Delta t_o$-$\Delta t_A$) by the screw down motor control means 11 (FIG. 1): when $\Delta t_A$ is smaller than $\Delta t_o$, the gap is reduced to increase the $\Delta t_A$, and if $\Delta t_A$ is larger than $\Delta t_o$, the roll gap is increased to decrease the $\Delta t_A$.

As described above, this invention provides a method for quantitative adjustment of the roll gap that has been impossible in the conventional technique.

Probability Of Industrial Utility

The prior art technique controls the screwing down of reeling rolls without taking into consideration the change in the temperature in longitudinal direction of the pipe on the entry side of the reeling mill, so the pipe leaving the rolls does not have a uniform outside diameter in the longitudinal direction, but this problem is not encountered in the method of this invention. In particular, a pipe both ends of which have an outside diameter equal to the desired value can be produced by the method of this invention.

Some of the prior art techniques provide a reeled pipe with a constant wall thickness only by scarificing the uniformity of the outside diameter of the pipe in its longitudinal direction, but this problem is also eliminated from the method of this invention.

The prior art technique is not capable of quantitative control of the degree by which the reeling rolls are screwed down, so depending on the dimensions of the pipe to be rolled, hunting or delay effect frequently occurs. According to this invention, the torque of the rolling motor is measured continuously to detect the actual amount of reduction in the wall thickness of the pipe at particular points of time, and so, only one value is determined for the amount of correction of the gap between the two rolls when the actual amount of reduction in wall thickness deviates from the desired amount of reduction in wall thickness. This achieves very reliable control operation without hunting or delay effect.

As described in the foregoing, the method of this invention assures the production of a seamless steel pipe of good quality whose outside diameter is equal to the desired value and which is entirely free from any flaw such as one due to the roll edges that develops during rolling in the sizing mill.

What is claimed is:

1. A method for controlling the automatic rolling of pipes in a reeling mill comprising the steps of:

determining the desired amount of reduction in wall thickness of said pipe being reeled;

continuously monitoring the voltage and current supplied to the rolling motor;

continuously monitoring the speed of said rolling motor;

calculating the torque of said rolling motor by a predetermined mathematical relationship of the voltage, the current and the speed of said rolling motor;

measuring the temperature of said pipe on the entry side of said rolling mill;

calculating the actual reduction in wall thickness based upon a predetermined relationship of said temperatures and said torque;

generating correction signals based upon the relationship between the desired reduction and said calculated actual reduction; and adjusting the screwing down of the reeling rolls in response to said correction signal.

2. A method according to claim 1 further comprising the steps of:

directly measuring the outside diameter of the pipe supplied to said reeling mill;

directly measuring the wall thickness of said pipe supplied to said reeling mill.

* * * * *